United States Patent [19]

Dulken et al.

[11] 3,973,960

[45] Aug. 10, 1976

[54] ELECTROPHOTOGRAPHIC ELEMENT HAVING A SELENIUM LAYER CONTAINING ARSENIC IN VARYING CONCENTRATIONS ACROSS THE LAYER THICKNESS

[75] Inventors: Hartmut Dulken; Gottfried Guder; Karl-Heinz Kassel, all of Belecke, Germany

[73] Assignee: Licentia Patent-Verwaltungs-G.m.b.H., Frankfurt am Main, Germany

[22] Filed: Feb. 1, 1974

[21] Appl. No.: 438,707

[30] Foreign Application Priority Data

Feb. 3, 1973 Germany ..... 2305342

[52] U.S. Cl. ..... 96/1.5; 427/76; 427/78

[51] Int. Cl.[2] ..... G03G 5/04

[58] Field of Search ..... 96/1.5, 1.6; 117/201, 117/119; 427/76, 78

[56] References Cited

UNITED STATES PATENTS

| | | | |
|---|---|---|---|
| 2,739,079 | 3/1956 | Keck | 96/1.5 X |
| 2,803,542 | 8/1957 | Ullrich | 96/1.5 |
| 3,041,166 | 6/1962 | Bardeen | 96/1.5 |
| 3,077,398 | 2/1963 | Jones | 96/1.8 |
| 3,288,604 | 11/1966 | Corrsin | 96/1 |
| 3,312,548 | 4/1967 | Straughan | 96/1.5 |
| 3,490,903 | 1/1970 | Myers et al. | 96/1.5 |
| 3,799,793 | 3/1974 | Smith et al. | 117/45 |
| 3,861,913 | 1/1975 | Chiou | 96/1.5 |

*Primary Examiner*—David Klein
*Assistant Examiner*—Judson R. Hightower
*Attorney, Agent, or Firm*—Spencer & Kaye

[57] ABSTRACT

Electrophotographic recording material composed of a layer of selenium, selenium alloys, or selenium compounds, with arsenic as a additive, disposed on a conductive carrier is given improved properties by forming the layer to have a total arsenic content of 1 to 20%, by weight, and a concentration gradient such that the arsenic concentration decreases from the exposed surface of the layer in the direction toward the carrier and has a concentration of at least 13% at the exposed surface of the layer.

11 Claims, No Drawings

ELECTROPHOTOGRAPHIC ELEMENT HAVING A SELENIUM LAYER CONTAINING ARSENIC IN VARYING CONCENTRATIONS ACROSS THE LAYER THICKNESS

BACKGROUND OF THE INVENTION

The present invention relates to electrophotographic recording materials, particularly those constituted by selenium, selenium alloys or selenium compounds applied to a conductive carrier and containing arsenic as an additive.

Electrophotographic processes and apparatus for this purpose are widely used in the duplication art. They rely on the property of the photoconductive material to change its electrical resistance when exposed to an activating radiation.

After a photoconductive layer is electrically charged and exposed to an activating radiation, it is possible to produce thereon a latent electrical charge image which corresponds to the optical image which constitutes the activating radiation source. At the exposed points there occurs such an increase in the conductivity of the photoconductive layer that the electrical charge can flow out through the conductive carrier. More precisely, at least part of the stored charge will flow out and in any case more will flow off from exposed points than from the unexposed points. At the same time, at the unexposed points the electrical charge remains substantially unchanged. The resulting charge image can be made visible with a picture powder, a so-called toner, and the resulting toner image can finally be transferred to paper or some other medium, if this should be required.

Organic as well as inorganic substances are used as the electrophotographically active substances. Among them, selenium, selenium alloys and selenium compounds have gained particular significance.

Various demands are placed on the mechanical, optical, electrical and thermal properties of electrophotographically active substances if they are to be employed with success and advantage in practice. No single prior art layer could meet all of these demands. It is known, however, to improve certain properties of electrophotographically active substances through the use of additives.

Thus, the low thermal stability of layers of amorphous selenium, which has a generally undesirable tendency to change to the crystalline state, can be improved by the addition of arsenic. Also, the low hardness of amorphous selenium layers can be improved, according to known processes, by the addition of arsenic in concentrations of up to 1%, with a possible concentration gradient which increases in the direction toward the surface. In a known arrangement the arsenic concentration at the surface is then up to 13%. With such an arrangement the improvement in thermal stability and hardness must be paid for, however, by a reduction in sensitivity.

Homogeneous selenium-arsenic systems are also known in which the atomic mixing ratio reaches 1:1. These systems have a higher sensitivity with higher arsenic concentration than can be observed with pure selenium. The maximum in sensitivity is observed with $As_2 Se_3$, which corresponds to 38.74% by weight of arsenic.

Such systems with such high proportions of arsenic, however, also have high glass transformation temperatures. For this reason the production of electrophotographic layers exhibiting good adhesion is possible only at very high substrate temperatures in the vicinity of approximately 200°C, which presents technical difficulties.

SUMMARY OF THE INVENTION

It is an object of the present invention to provide improved electrophotographic recording materials.

Another object of the invention is to provide an electrophotographic recording material, based on selenium with a proportion of arsenic, distinguished by greater hardness and a greater thermal stability without an accompanying reduction in sensitivity. The recording material can also be applied to the conductive carrier, with even higher sensitivity, by means of a simple vapor-deposition process at substrate temperatures which are as low as possible.

A further object of the invention is to provide a method for fabricating such materials.

The invention involves an electrophotographic recording material of selenium, a selenium alloy or a selenium compound applied to a conductive carrier and containing arsenic as a further component. According to the present invention, the total amount of arsenic lies between 1 and 20% by weight and has a concentration gradient such that the concentration of arsenic decreases from the exposed surface of the layer in the direction toward the carrier, the arsenic concentration at the free surface being at least 13%.

Preferably the total quantity of arsenic is between 1.5 and 15% by weight and its concentration at the free surface is more than 20% by weight. Advantageously, such a concentration profile is produced by appropriate temperature regulation during vapor-deposition of selenium containing arsenic at a concentration of more than 1% by weight.

The electrophotographic recording material according to the invention not only presents a greater hardness and thermal stability than exist in layers without arsenic, it also exhibits, depending on the high surface concentration of the arsenic, a particularly high surface hardness and high thermal surface stability. Both properties are of importance for practical application because they substantially eliminate both wear and the conversion from the amorphous to the crystalline state, which often begins particularly at the surface.

In contradistinction to known recording materials, the material according to the present invention also possesses an increased sensitivity because it is possible to maintain the arsenic concentration in the layers near its surface at levels at which there exists an increased sensitivity to light, the sensitivity to light being determined quite predominantly by the property of the light absorbing surface. With asurface concentration of approximately 30% by weight arsenic, which is possible to be produced with the process according to the present invention, the maximum value for sensitivity is nearly reached.

In spite of this high sensitivity, which is due to the high surface concentration of the arsenic, the electrophotographic recording material according to the present invention can be applied at low substrate temperatures. At the beginning of the vapor-deposition process the arsenic content is only slight as a result of the temperature regulation employed during the vapor deposition process and this low arsenic content corresponds to a low glass transformation temperature. This again results in a low substrate temperature and a better yield of the vapor-deposition material.

The concentration gradient is set by causing the vapor-deposition to take place from a source, or possibly from a plurality of sources, with the appropriate temperature regulation, the sources preferably being porcelain vessels or vessels made of a resistant metal, filled with the individual elements and/or mixtures or melts of the components forming the photoconductive layer.

In further embodiments of the present invention, the recording material contains additionally one or a plurality of halogens at a concentration of from 1 to 10,000 ppm, preferably from 5 to 100 ppm, whose purpose is to prevent a residual potential and to compensate differences in conductivity which would lead to unfavorable field distributions. This halogen or these halogens are distributed in the recording material either uniformly or with a concentration gradient. In the latter case, the halogen component is preferably disposed predominantly in the portion of the recording material which contains the lower arsenic concentrations. Chlorine and iodine are the preferred halogen additives.

The recording material of the present invention and the method for producing it will be described in greater detail below in connection with two preferred embodiments of the present invention.

DESCRIPTION OF THE PREFERRED EMBODIMENTS

In a first embodiment, the vapor-deposition substance is a mixture containing 98.5%, by weight, selenium and 1.5% by weight arsenic which are initially melted together according to a standard method. The melt is then vapor-deposited from a tantalum crucible at a pressure of about $10^{-5}$ Torr onto a rotating aluminum drum. During the vapor-deposition process, which continues for approximately 50 minutes, the crucible temperature is progressively increased, from 260° to 290°C. The drum temperature in this case is approximately 85°C, and is thus substantially lower than the substrate temperature usually used for high arsenic concentrations. The material is weighed into the crucible in such a way that complete evaporation will result in a layer thickness on the drum of about 50$\mu$. The arsenic concentration in the vapor-deposited layer at the exposed surface is approximately 18% by weight. The average concentration of arsenic in the lower third of the layer has been analyzed at 0.2% by weight.

Such a layer has been found to be twice as sensitive as a pure selenium layer, about four times as sensitive as a selenium layer containing 1.5% by weight arsenic in homogeneous distribution and about six times as sensitive as a selenium layer having a total concentration of 1% by weight arsenic and a concentration gradient such that it has a concentration of 13% by weight arsenic at the exposed surface.

According to a second embodiment, the vapor-deposition material is a mixture of 80% by weight selenium and 20% by weight arsenic. It is vapor-deposited under vacuum, as described above in connection with the first embodiment, from a tantalum crucible onto a rotating drum. The crucible temperature in this embodiment varies progressively, at a constant rate, between 325° and 360°C, while the drum temperature is kept constant at approximately 170°C. The quantities employed, the time required for complete evaporation and the resulting layer thickness correspond to values for the first embodiment. The arsenic concentration in the vapor-deposited layer at the exposed surface is 28 to 30% by weight. However, in contrast to the first example at the beginning of the vapor-deposition a relatively high concentration of arsenic, over 15% by weight, is found.

This layer has an approximately four times higher sensitivity than a pure selenium layer, and two and one half times higher sensitivity than a selenium layer with the same total concentration of arsenic but with a homogeneous distribution.

In general, if the material to be vapor-deposited has a low arsenic concentration, i.e. in the range 1.5 to 5% by weight, then the arsenic concentration in the vapor-deposited layer in the proximity of the substrate is found to be very low at the beginning of vapor-deposition increasing steeply in the last third of the layer. However, at higher arsenic concentrations of the material to be vapor-deposited, i.e. in the range 15 to 20% by weight, considerably higher arsenic concentrations are found in the lower region in the proximity of the substrate — the concentration curve is increasing less steeply and is less curved.

Moreover, it is generally found that the arsenic concentration in the lower region of the vapor deposited layer in the proximity of the substrate is higher with higher crucible temperatures.

A further example of the material to be vapor-deposited is a selenium alloy containing 5% by weight sulfur and 1.5% by weight arsenic. If this alloy is vapor-deposited according to the method given in example 1, the arsenic concentration gradient is similar to that of the selenium without the sulfur addition, as in example 1.

A further example of the material to be vapor-deposited is a selenium alloy containing 1.5% by weight arsenic and 20 ppm chlorine. If this alloy is vapor-deposited according to the method given in example 1, the arsenic concentration gradient is similar to that in example 1. The chlorine is almost homogeneously distributed.

It will be understood that the above description of the present invention is susceptible to various modifications, changes and adaptations and the same are intended to be comprehended within the meaning and range of equivalents of the appended claims.

We claim:

1. In an electrophotographic recording material composed of a layer of selenium, at least one selenium alloy or at least one selenium compound applied to a conductive carrier and containing arsenic as an additive, the improvement wherein the total quantity of arsenic in said layer is between 1 and 20%, by weight, the arsenic is distributed in the layer with a concentration gradient such that the concentration of arsenic decreases from the free surface of the layer in the direction toward the carrier, and the arsenic concentration at the free surface is at least 13% by weight.

2. Electrophotographic recording material as defined in claim 1 wherein the total quantity of arsenic is between 1.5 and 15% by weight.

3. Electrophotographic recording material as defined in claim 1 wherein the concentration of arsenic at the free surface of the layer is more than 20% by weight.

4. Electrophotographic recording material as defined in claim 1 wherein the recording material additionally contains at least one halogen.

5. Electrophotographic recording material as defined in claim 4 wherein the halogen concentration in the recording material is between 1 and 10,000 ppm.

6. Electrophotographic recording material as defined in claim 5 wherein the halogen concentration in the recording material is between 5 and 100 ppm.

7. Electrophotographic recording material as defined in claim 4 wherein the halogen is distributed in the recording material with a concentration gradient.

8. Electrophotographic recording material as defined in claim 7 wherein the greatest halogen concentration is in the portion of the material having a lower arsenic concentration.

9. A process for producing an electrophotographic recording material composed of a layer of selenium, at least one selenium alloy or at least one selenium compound, and containing arsenic in a total concentration of between 1 to 20%, by weight, comprising:

vapor-depositing the component substances for such layer from at least one source onto a conductive carrier; and progressively varying the temperature of such source during said vapor-depositing step in a manner to progressively increase the rate of deposition of the arsenic component for causing the arsenic concentration in the resulting layer to increase progressively in the direction away from the carrier and to have a value of at least 13%, by weight, at the surface of the resulting layer which is remote from the carrier.

10. A process as defined in claim 9 wherein the component substances are initially present in a crucible as a molten mixture of 98.5% selenium and 1.5% arsenic, both by weight, the carrier is in the form of a drum, said step of progressively varying is carried out by progressively increasing the temperature of the crucible between 260° and 290°C while maintaining the temperature of the drum constant at about 85°C, and said steps of vapor-depositing and progressively varying are carried out for a period of about 50 minutes.

11. A process as defined in claim 9 wherein the component substances are initially present in a crucible as a molten mixture of 80% selenium and 20% arsenic, both by weight, the carrier is in the form of a drum, said step of progressively varying is carried out by progressively increasing the temperature of the crucible between 325° and 360°C while maintaining the temperature of the drum constant at about 170°C, and said steps of vapor-depositing and progressively varying are carried out for a period of about 50 minutes.

* * * * *